US005972042A

United States Patent [19]

Barfoed et al.

[11] Patent Number: 5,972,042

[45] **Date of Patent: *Oct. 26, 1999**

[54] METHOD FOR DYEING A MATERIAL WITH A DYEING SYSTEM WHICH CONTAINS AN ENZYMATIC OXIDIZING AGENT

[75] Inventors: Martin Barfoed, Raleigh, N.C.; Ole Kirk, Virum, Denmark

[73] Assignees: Novo Nordisk A/S, Bagsvaerd, Germany; Novo Nordisk Bio-Chem North America, Franklinton, N.C.

[ * ] Notice: This patent is subject to a terminal disclaimer.

[21] Appl. No.: 08/770,755

[22] Filed: Dec. 19, 1996

Related U.S. Application Data

[60] Provisional application No. 60/018,619, May 2, 1996, abandoned, and provisional application No. 60/009,198, Dec. 22, 1995, abandoned.

[51] Int. Cl.[6] ..... D06P 1/32; D06P 5/00

[52] U.S. Cl. ..... 8/401; 8/552; 8/618; 8/649; 8/916; 8/918; 8/920; 8/921; 8/922; 8/924

[58] Field of Search ..... 8/401, 553, 552, 8/618, 649, 666, 667, 668, 670, 918, 916, 921, 922, 924, 920

[56] References Cited

U.S. PATENT DOCUMENTS

| | | | |
|---|---|---|---|
| 2,539,202 | 1/1951 | Peck | 8/401 |
| 2,926,060 | 2/1960 | Lehmann et al. | 8/649 |
| 3,251,742 | 5/1966 | Soloway | 8/401 |
| 3,893,803 | 7/1975 | Kaiser | 8/401 |
| 3,912,447 | 10/1975 | Schmidt | 8/598 |
| 3,925,012 | 12/1975 | Ringel et al. | 8/602 |
| 3,957,424 | 5/1976 | Zeffren et al. | 8/401 |
| 3,993,436 | 11/1976 | Fujinuma | 8/401 |
| 4,283,196 | 8/1981 | Wenghoefer et al. | 8/531 |
| 4,961,925 | 10/1990 | Tsujino et al. | 8/401 |
| 5,104,646 | 4/1992 | Bolich, Jr. et al. | 8/405 |
| 5,538,517 | 7/1996 | Samain et al. | 8/401 |

FOREIGN PATENT DOCUMENTS

| | | |
|---|---|---|
| 0 431 682 | 6/1991 | European Pat. Off. . |
| 2112549 | 6/1972 | France . |
| 2694018 | 1/1994 | France . |
| 2-104773 | 4/1990 | Japan . |
| 6-316874 | 11/1994 | Japan . |
| 92/18683 | 10/1992 | WIPO . |
| 94/00100 | 1/1994 | WIPO . |
| 95/33836 | 12/1995 | WIPO . |

OTHER PUBLICATIONS

Derwent Publication Ltd., XP 002030252 (Apr. 17, 1990).
Derwent Publication Ltd., XP 002030253 (Apr. 3, 1990).
Derwent Publication Ltd., XP 002030254 (Nov. 15, 1994).
Derwent Publication Ltd., XP 002030255 (May 21, 1996).
English language translation of Kurabo, JP 6–316,874, pp. 1–8, Nov. 1994.
English language translation of JP 2–104,773, Nagase Co. Ltd., pp. 1–19, Apr. 17, 1990.
Fairchild's Dictionary of Textiles, Fairchild Publications, Inc., New York, p. 450, "polyamide.", 1959.

*Primary Examiner*—Yogendra Gupta
*Assistant Examiner*—Caroline D. Liott
*Attorney, Agent, or Firm*—Steve T. Zelson, Esq.; Cheryl H. Agris, Esq.

[57] ABSTRACT

Methods of dyeing a material, comprising treating the material with a dyeing system which comprises (a) one or more mono-, di- or polycyclic aromatic or heteroaromatic compounds, and (b) (i) a hydrogen peroxide source and an enzyme exhibiting peroxidase activity or (ii) an enzyme exhibiting oxidase activity on the one or more aromatic or heteroaromatic compounds; wherein the material is a fabric, yarn, fiber, garment or film made of cotton, diacetate, flax, linen, lyocel, polyacrylic, synthetic polyamide, polyester, ramie, rayon, tencel, or triacetate.

28 Claims, No Drawings

METHOD FOR DYEING A MATERIAL WITH A DYEING SYSTEM WHICH CONTAINS AN ENZYMATIC OXIDIZING AGENT

CROSS-REFERENCE TO RELATED APPLICATIONS

This application claims the benefit of U.S. Provisional Application Serial Nos. 60/018,619 filed May 2, 1996, now abandoned, and 60/009,198 filed Dec. 22, 1995, now abandoned.

FIELD OF THE INVENTION

The present invention relates to methods of dyeing a material, comprising treating the material with a dyeing system which comprises (a) one or more mono-, di- or polycyclic aromatic or heteroaromatic compounds, and (b) (i) a hydrogen peroxide source and an enzyme exhibiting peroxidase activity or (ii) an enzyme exibiting oxidase activity on the one or more aromatic or heteroaromatic compounds; wherein the material is a fabric, yarn, fiber, garment or film made of cotton, diacetate, flax, linen, lyocel, polyacrylic, synthetic polyamide, polyester, ramie, rayon, tencel, or triacetate.

BACKGROUND OF THE INVENTION

Dyeing of textiles is often considered to be the most important and expensive single step in the manufacturing of textile fabrics and garments. In the textile industry, two major types of processes are currently used for dyeing, i.e., batch and continuous. In the batch process, among others, jets, drums, and vat dyers are used. In continuous processes, among others, padding systems are used. See, e.g., I. D. Rattee, In C. M. Carr (Ed.), "The Chemistry of the Textiles Industry," Blackie Academic and Professional, Glasgow, 1995, p. 276.

The major classes of dyes are azo (mono-, di-, tri-, etc.), carbonyl (anthraquinone and indigo derivatives), cyanine, di- and triphenylmethane and phthalocyanine. All these dyes contain chromophoric groups which give rise to color. There are three types of dyes involving an oxidation/reduction mechanism, i.e., vat, sulfur and azoic dyes. The purpose of the oxidation/reduction step in these dyeings are to change the dyestuff between an insoluble and a soluble form.

Oxidoreductases, e.g., oxidases and peroxidases, are well known in the art.

One class of oxidoreductases is laccases (benzenediol:oxygen oxidoreductases) which are multi-copper containing enzymes that catalyze the oxidation of phenols and related compounds. Laccase-mediated oxidation results in the production of aromatic radical intermediates from suitable substrates; the ultimate coupling of the intermediates so produced provides a combination of dimeric, oligomeric, and polymeric reaction products. Such reactions are important in nature in biosynthetic pathways which lead to the formation of melanin, alkaloids, toxins, lignins, and humic acids.

Another class of oxidoreductases are peroxidases which oxidize compounds in the presence of hydrogen peroxide.

Laccases have been found to be useful for hair dyeing. See, e.g., PCT application Ser. Nos. PCT/US95/06815 and PCT/US95/06816. European Patent No. 0504005 discloses that laccases can be used for dyeing wool at a pH in the range of between 6.5 and 8.0.

Saunders et al., *Peroxidase,* London, 1964, p. 10 ff. disclose that peroxidases act on various amino and phenolic compounds resulting in the production of a color.

Japanese Patent Application publication no. 6-316874 discloses a method for dyeing cotton comprising treating the cotton with an oxygen-containing medium, wherein an oxidation reduction enzyme selected from the group consisting of ascorbate oxidase, bilirubin oxidase, catalase, laccase, peroxidase, and polyphenol oxidase is used to generate the oxygen.

WO 91/05839 discloses that oxidases and peroxidases are useful for inhibiting the transfer of textile dyes.

It is an object of the present invention to provide an enzymatic method of dyeing fabrics.

SUMMARY OF THE INVENTION

The present invention relates to methods of dyeing a material, comprising treating the material with a dyeing system which comprises (a) one or more mono-, di- or polycyclic aromatic or heteroaromatic compounds, each of which is optionally substituted with one or more functional groups or substituents, wherein each functional group or substituent is selected from the group consisting of halogen; sulfo; sulfonato; sulfamino; sulfanyl; amino; amido; nitro; azo; imino; carboxy; cyano; formyl; hydroxy; halocarbonyl; carbamoyl; carbamidoyl; phosphonato; phosphonyl; $C_{1-18}$-alkyl; $C_{1-18}$-alkenyl; $C_{1-18}$-alkynyl; $C_{1-18}$-alkoxy; $C_{1-18}$-oxycarbonyl; $C_{1-18}$-oxoalkyl; $C_{1-18}$-alkyl sulfanyl; $C_{1-18}$-alkyl sulfonyl; $C_{1-18}$-alkyl imino or amino which is substituted with one, two or three $C_{1-18}$-alkyl groups; and (b) (i) a hydrogen peroxide source and an enzyme exhibiting peroxidase activity or (ii) an enzyme exhibiting oxidase activity on the one or more aromatic or heteroaromatic compounds; wherein the material is a fabric, yam, fiber, garment or film made of cotton, diacetate, flax, linen, lyocel, polyacrylic, polyamide (e.g., nylon), polyester, ramie, rayon (e.g., viscose), tencel, or triacetate.

DETAILED DESCRIPTION OF THE INVENTION

The use of oxidoreductases for dyeing materials has several significant advantages. For example, the dyeing system used in the process of the present invention utilizes inexpensive color precursors. Moreover, the mild conditions (e.g., lower temperature and less time) in the process will result in less damage to the fabric and lower consumption of energy.

In the methods of the present invention, a material is dyed using one or more mono-, di- or polycyclic aromatic or heteroaromatic compounds, each of which is optionally substituted with one or more functional groups or substituents, wherein each functional group or substituent is selected from the group consisting of halogen; sulfo; sulfonato; sulfamino; sulfanyl; amino; amido; nitro; azo; imino; carboxy; cyano; formyl; hydroxy; halocarbonyl; carbamoyl; carbamidoyl; phosphonato; phosphonyl; $C_{1-18}$-alkyl; $C_{1-18}$-alkenyl; $C_{1-18}$-alkynyl; $C_{1-18}$-alkoxy; $C_{1-18}$-oxycarbonyl; $C_{1-18}$-oxoalkyl; $C_{1-18}$-alkyl sulfanyl; $C_{1-18}$-alkyl sulfonyl; $C_{1-18}$-alkyl imino or amino which is substituted with one, two or three $C_{1-18}$-alkyl groups. All $C_{1-18}$-alkyl, $C_{1-18}$-alkenyl and $C_{1-18}$-alkynyl groups may be mono-, di or poly-substituted by any of the proceeding functional groups or substituents. Examples of such mono-, di- or polycyclic aromatic or heteroaromatic compounds include, but are not limited to, acridine, anthracene, azulene, benzene, benzofurane, benzothiazole, benzothiazoline, carboline, carbazole, cinnoline, chromane, chromene, chrysene, fulvene, furan, imidazole, indazole, indene, indole, indoline, indolizine, isothiazole, isoquinoline, isoxazole, naphthalene, naphthylene, naphthylpyridine, oxazole, perylene, phenanthrene, phenazine, phtalizine, pteridine, purine, pyran, pyrazole, pyrene, pyridazine, pyridazone, pyridine, pyrimidine, pyrrole, quinazoline, quinoline, quinoxaline, sulfonyl, thiophene, and triazine, each of which are optionally substituted. Examples of such compounds include, but are not limited to, aromatic diamines, aminophenols, phenols and naphthols.

Examples of aromatic and heteroaromatic compounds for use in the present invention include, but are not limited to:

3,4-diethoxyaniline
2-methoxy-p-phenylenediamine,
1-amino-4-β-methoxyethylamino-benzene (N-β-methoxyethyl p-phenylenediamine),
1 -amino-4-bis-(β-hydroxyethyl)-aminobenzene (N,N-bis-(β-hydroxyethyl)-p-phenylenediamine),
2-methyl-1,3-diamino-benzene (2,6-diaminotoluene),
2,4-diaminotoluene,
2,6-diaminopyridine,
1-amino-4-sulfonato-benzene,
1-N-methylsulfonato-4-aminobenzene,
1-methyl-2-hydroxy-4-amino-benzene (3-amino o-cresol),
1- -methyl-2-hydroxy-4-β-hydroxyethylamino-benzene (2-hydroxy-4-β-hydroxyethylamino-toluene),
1-hydroxy-4-methylamino-benzene (p-methylaminophenol),
1-methoxy-2,4-diamino-benzene (2,4-diaminoanisole),
1-ethoxy-2,3-diamino-benzene (2,4-diaminophenetole),
1-β-hydroxyethyloxy-2,4-diamino-benzene (2,4-diaminophenoxyethanol),
1,3-dihydroxy-2-methylbenzene (2-methyl resorcinol),
1,2,4-trihydroxybenzene,
1,2,4-trihydroxy-5-methylbenzene (2,4,5-trihydroxytoluene),
2,3,5-trihydroxytoluene,
4,8-disulfonato-1-naphthol,
3-sulfonato-6-amino-1-naphthol (J acid),
6,8-disulfonato-2-naphthol,
1,4-Phenylenediamine
2,5-Diaminotoluene
2-Chloro-1,4-phenylenediamine
2-Aminophenol
3-Aminophenol
4-Aminophenol
1,3-Phenylenediamine
1-Naphthol
2-Naphthol
4-Chlororesorcinol
1,2,3-benzenetriol (Pyrogallol)
1,3-Benzenediol (Resorcinol)
1,2-Benzenediol (Pyrocatechol)
2-Hydroxy-cinnamic acid
3-Hydroxy-cinnamic acid
4-Hydroxy-cinnamic acid
2,3-diaminobenzoic acid
2,4-diaminobenzoic acid
3,4-diaminobenzoic acid
3,5-diaminobenzoic acid
Methyl 2,3-diaminobenzoate
Ethyl 2,3-diaminobenzoate
Isopropyl 2,3-diaminobenzoate
Methyl 2,4-diaminobenzoate
Ethyl 2,4-diaminobenzoate
Isopropyl 2,4-diaminobenzoate
Methyl 3,4-diaminobenzoate
Ethyl 3,4-diaminobenzoate
Isopropyl 3,4-diaminobenzoate
Methyl 3,5-diaminobenzoate
Ethyl 3,5-diaminobenzoate
Isopropyl 3,5-diaminobenzoate
N,N-diethyl-3,4-diaminobenzoic acid amide
N,N-diethyl-3,4-diaminobenzoic acid amide
N,N-dipropyl-3,4-diaminobenzoic acid amide
N,N-dibutyl-3,4-diaminobenzoic acid amide
4-Chloro-1-naphthol
N-Phenyl-p-phenylenediamine
3,4-Dihydroxybenzaldehyde
Pyrrole
Pyrrole-2-isoimidazole
1,2,3-Triazole
Benzotriazole
Benzimidazole
Imidazole
Indole
1-Amino-8-hydroxynaphthalene-4-sulfonic acid (S acid)
4,5-Dihydroxynapthalene-2,7-disulfonic acid (Chromotropic acid)
Anthranilic acid
4-Aminobenzoic acid (PABA)
2-Amino-8-naphthol-6-sulfonic acid (Gamma acid)
5-Amino-1-naphthol-3-sulfonic acid (M acid)
2-Naphthol-3,6-disulfonic acid (R acid)
1-Amino-8-naphthol-2,4-disulfonic acid (Chicago acid)
1-Naphthol-4-sulfonic acid (Nevile and Winther's acid)
Peri acid
N-Benzoyl J acid
N-Phenyl J acid
1,7-Cleves acid
1,6-Cleves acid
BON acid
Naphthol AS
Disperse Black 9
Naphthol AS OL
Naphthol AS PH
Naphthol AS KB
Naphthol AS BS
Naphthol AS D
Naphthol AS BI
Mordant Black 3 CI 14640 (Eriochrome Blue Black B)
4-Amino-5-hydroxy-2,6-Naphthalene Disulphonic acid (H acid)
Fat Brown RR, Solvent Brown 1 (CI 11285)
Hydroquinone
Mandelic Acid
Melamine
o-Nitrobenzaldehyde
1,5-Dihydroxynaphthalene
2,6-Dihydroxynaphthalene
2,3-Dihydroxynaphthalene
Benzylimidazole
2,3-Diaminonaphthalene
1,5-Diaminonaphthalene
1,8-Diaminonaphthalene
Salicylic acid
3-aminosalicylic acid
4-aminosalicylic acid
5-aminosalicylic acid
Methyl-3-aminosalicylate
Methyl-4-aminosalicylate
Methyl-5-aminosalicylate
Ethyl-3-aminosalicylate
Ethyl-4-aminosalicylate
Ethyl-5-aminosalicylate
Propyl-3-aminosalicylate Propyl-4-aminosalicylate
Propyl-5-aminosalicylate
Salicylic amide
4-Aminothiophenol
4-Hydroxythiophenol
Aniline
4,4'-Diaminodiphenylamine sulfate
4-Phenylazoaniline
4-Nitroaniline
N,N-Dimethyl-1,4-phenylenediamine
N,N-Diethyl-1,4-phenylenediamine
Disperse Orange 3
Disperse Yellow 9
Disperse Blue 1
N-Phenyl-1,2-phenylenediamine
6-Amino-2-naphthol
3-Amino-2-naphthol
5-Amino-1-naphthol
1,2-Phenylenediamine
2-Aminopyrimidine
4-Aminoquinaldine
2-Nitroaniline
3-Nitroaniline
2-Chloroaniline
3-Chloroaniline
4-Chloroaniline
4-(phenylazo)resorcinol (Sudan Orange G, CI 11920)
Sudan Red B, CI 26110
Sudan Red 7B, CI 26050
4'-Aminoacetanilide
Alizarin
1-Anthramine (1-Aminoanthracene)
1-Aminoanthraquinone
Anthraquinone
2,6-Dihydroxyanthraquinone (Anthraflavic Acid)
1,5-Dihydroxyanthraquinone (Anthrarufin)
3-Amidopyridine (Nicotinamide)
Pyridine-3-carboxylic acid (Nicotinic Acid)
Mordant Yellow 1, Alizarin Yellow GG, CI 14025
Coomassie Grey, Acid Black 48, CI 65005
Palantine Fast Black WAN, Acid Black 52, CI 15711
Palantine Chrome Black 6BN, CI 15705, Eriochrome Blue Black R
Mordant Black 11, Eriochrome Black T
Naphthol Blue Black, Acid Black 1, CI 20470
1,4-Dihydroxyanthraquinone (Quinizarin)
4-Hydroxycoumarin
Umbelliferone, 7-Hydroxycoumarin
Esculetin, 6,7-Dihydroxycoumarin
Coumarin
Chromotrope 2B, Acid Red 176, CI 16575
Chromotrope 2R, Acid Red 29, CI 16570
Chromotrope FB, Acid Red 14, CI 14720
2,6-Dihydroxyisonicotinic acid, Citrazinic acid
2,5-Dichloroaniline
2-Amino-4-chlorotoluene
2-Nitro-4-chloroaniline
2-Methoxy-4-nitroaniline and
p-Bromophenol.

The material dyed by the methods of the present invention is a fabric, yarn, fiber, garment or film. Preferably, the material is made of cotton, diacetate, flax, linen, lyocel, polyacrylic, polyamide (e.g., nylon), polyester, ramie, rayon, tencel, or triacetate.

The dye liquor, which comprises the material, used in the methods of the present invention may have a water/material ratio in the range of about 0.5:1 to about 200:1, preferably about 5:1 to about 20:1.

According to the methods of the present invention, the one or more mono-, di- or polycyclic aromatic or heteroaromatic compounds may be oxidized by (a) a hydrogen peroxide source and an enzyme exhibiting peroxidase activity or (b) an enzyme exhibiting oxidase activity on the one or more mono-, di- or polycyclic aromatic or heteroaromatic compounds, e.g., phenols and related substances. Enzymes exhibiting peroxidase activity include, but are not limited to, peroxidase (EC 1.11.1.7) and haloperoxidase, e.g., chloro- (EC 1.11.1.10), bromo- (EC 1.11.1) and iodoperoxidase (EC 1.11.1.8). Enzymes exhibiting oxidase activity include, but are not limited to, bilirubin oxidase (EC 1.3.3.5), catechol oxidase (EC 1.10.3.1), laccase (EC 1.10.3.2), o-aminophenol oxidase (EC 1.10.3.4), and polyphenol oxidase (EC 1.10.3.2). Assays for determining the activity of these enzymes are well known to persons of ordinary skill in the art.

Preferably, the enzyme is a laccase obtained from a genus selected from the group consisting of Aspergillus, Botrytis, Collybia, Fomes, Lentinus, Myceliophthora, Neurospora, Pleurotus, Podospora, Polyporus, Scytalidium, Trametes, and Rhizoctonia. In a more preferred embodiment, the laccase is obtained from a species selected from the group consisting of *Humicola brevis* var. *thermoidea, Humicola brevispora, Humicola grisea* var. *thermoidea, Humicola insolens,* and *Humicola lanuginosa* (also known as *Thermomyces lanuginosus*), *Myceliophthora thermophila, Myceliophthora vellerea, Polyporus pinsitus, Scytalidium thermophila, Scytalidium indonesiacum,* and *Torula thermophila.* The laccase may be obtained from other species of Scytalidium, such as *Scytalidium acidophilum, Scytalidium album, Scytalidium aurantiacum, Scytalidium circinatum, Scytalidium flaveobrunneum, Scytalidium hyalinum, Scytalidium lignicola,* and *Scytalidium uredinicolum.* The laccase may be obtained from other species of Polyporus, such as *Polyporus zonatus, Polyporus alveolaris, Polyporus arcularius, Polyporus australiensis, Polyporus badius, Polyporus biformis, Polyporus brumalis, Polyporus ciliatus, Polyporus colensoi, Polyporus eucalyptorum, Polyporus meridionalis, Polyporus varius, Polyporus palustris, Polyporus rhizophilus, Polyporus rugulosus, Polyporus squamosus, Polyporus tuberaster,* and *Polyporus tumulosus.* The laccase may also be obtained from a species of Rhizoctonia, e.g., *Rhizoctonia solani.* The laccase may also be a modified laccase by at least one amino acid residue in a Type I (T1) copper site, wherein the modified oxidase possesses an altered pH and/or specific activity relative to the wild-type oxidase. For example, the modified laccase could be modified in segment (a) of the T1 copper site.

Peroxidases which may be employed for the present purpose may be isolated from and are producible by plants (e.g., horseradish peroxidase) or microorganisms such as fungi or bacteria. Some preferred fungi include strains belonging to the subdivision Deuteromycotina, class Hyphomycetes, e.g., Fusarium, Humicola, Trichoderma, Myrothecium, Verticillum, Arthromyces, Caldariomyces, Ulocladium, Embellisia, Cladosporium or Dreschlera, in particular *Fusarium oxysporum* (DSM 2672), *Humicola insolens, Trichoderma resii, Myrothecium verrucana* (IFO 6113), *Verticillum alboatrum, Verticillum dahlie, Arthromyces ramosus* (FERM P-7754), *Caldariomyces fumago, Ulocladium chartarum, Embellisia alli* or *Dreschlera halodes.*

Other preferred fungi include strains belonging to the subdivision Basidiomycotina, class Basidiomycetes, e.g., Coprinus, Phanerochaete, Coriolus or Trametes, in particular *Coprinus cinereus* f. *microsporus* (IFO 8371), *Coprinus macrorhizus, Phanerochaete chrysosporium* (e.g., NA-12) or *Coriolus versicolor* (e.g., PR4 28-A).

Further preferred fungi include strains belonging to the subdivision Zygomycotina, class Mycoraceae, e.g., Rhizopus or Mucor, in particular *Mucor hiemalis.*

Some preferred bacteria include strains of the order Actinomycetales, e.g., *Streptomyces spheroides* (ATTC 23965), *Streptomyces thermoviolaceus* (IFO 12382) or *Streptoverticillum verticillium* ssp. *verticillium.*

Other preferred bacteria include *Bacillus pumillus* (ATCC 12905), *Bacillus stearothermophilus, Rhodobacter sphaeroides, Rhodomonas palustri, Streptococcus lactis, Pseudomonas purrocinia* (ATCC 15958) or *Pseudomonas fluorescens* (NRRL B-11).

Other potential sources of peroxidases are listed in B. C. Saunders et al., op. cit., pp. 41–43.

Methods of producing enzymes to be used according to the invention are described in the art, e.g., *FEBS Letters* 1625, 173(1), *Applied and Environmental Microbiology,* February 1985, pp. 273–278, *Applied Microbiol. Biotechnol.* 26, 1987, pp. 158–163, *Biotechnology Letters* 9(5), 1987, pp. 357–360, *Nature* 326, 2 April 1987, *FEBS Letters* 4270, 209(2), p. 321, EP 179 486, EP 200 565, GB 2 167 421, EP 171 074, and *Agric. Biol. Chem.* 50(1), 1986, p. 247.

Particularly preferred enzymes are those which are active at a pH in the range of about 2.5 to about 12.0, preferably in the range of about 4 to about 10, most preferably in the range of about 4.0 to about 7.0 and in the range of about 7.0 to about 10.0. Such enzymes may be isolated by screening for the relevant enzyme production by alkalophilic microorganisms, e.g., using the ABTS assay described in R. E. Childs and W. G. Bardsley, *Biochem. J.* 145, 1975, pp. 93–103.

Other preferred enzymes are those which exhibit a good thermostability as well as a good stability towards commonly used dyeing additives such as non-ionic, cationic, or anionic surfactants, chelating agents, salts, polymers, etc.

The enzymes may also be produced by a method comprising cultivating a host cell transformed with a recombinant DNA vector which carries a DNA sequence encoding said enzyme as well as DNA sequences encoding functions permitting the expression of the DNA sequence encoding the enzyme, in a culture medium under conditions permitting the expression of the enzyme and recovering the enzyme from the culture.

A DNA fragment encoding the enzyme may, for instance, be isolated by establishing a cDNA or genomic library of a microorganism producing the enzyme of interest, such as one of the organisms mentioned above, and screening for positive clones by conventional procedures such as by hybridization to oligonucleotide probes synthesized on the basis of the full or partial amino acid sequence of the enzyme, or by selecting for clones expressing the appropriate enzyme activity, or by selecting for clones producing a protein which is reactive with an antibody against the native enzyme.

Once selected, the DNA sequence may be inserted into a suitable replicable expression vector comprising appropriate promotor, operator and terminator sequences permitting the enzyme to be expressed in a particular host organism, as well as an origin of replication enabling the vector to replicate in the host organism in question.

The resulting expression vector may then be transformed into a suitable host cell, such as a fungal cell, preferred examples of which are a species of Aspergillus, most preferably *Aspergillus oryzae* or *Aspergillus niger.* Fungal cells may be transformed by a process involving protoplast formation and transformation of the protoplasts followed by regeneration of the cell wall in a manner known per se. The use of Aspergillus as a host microorganism is described in EP 238,023 (of Novo Industri A/S), the contents of which are hereby incorporated by reference.

Alternatively, the host organisms may be a bacterium, in particular strains of Streptomyces, Bacillus, or *E. coli.* The transformation of bacterial cells may be performed according to conventional methods, e.g., as described in T. Maniatis et al., *Molecular Cloning: A Laboratory Manual,* Cold Spring Harbor, 1982.

The screening of appropriate DNA sequences and construction of vectors may also be carried out by standard procedures, cf. T. Maniatis et al., op. cit.

The medium used to cultivate the transformed host cells may be any conventional medium suitable for growing the host cells in question. The expressed enzyme may conveniently be secreted into the culture medium and may be recovered therefrom by well-known procedures including separating the cells from the medium by centrifugation or filtration, precipitating proteinaceous components of the medium by means of a salt such as ammonium sulphate, followed by chromatographic procedures such as ion exchange chromatography, affinity chromatography, or the like.

When the enzyme employed in the invention is a peroxidase, a hydrogen peroxide source, e.g., hydrogen peroxide itself, must be used. The hydrogen peroxide source may be added at the beginning or during the process, e.g., in an amount of 0.001–5 mM, particularly 0.01–1 mM.

One source of hydrogen peroxide includes precursors of hydrogen peroxide, e.g., a perborate or a percarbonate. Another source of hydrogen peroxide includes enzymes which are able to convert molecular oxygen and an organic or inorganic substrate into hydrogen peroxide and the oxidized substrate, respectively. These enzymes produce only low levels of hydrogen peroxide, but they may be employed to great advantage in the process of the invention as the presence of peroxidase ensures an efficient utilization of the hydrogen peroxide produced. Examples of enzymes which are capable of producing hydrogen peroxide include, but are not limited to, glucose oxidase, urate oxidase, galactose oxidase, alcohol oxidase, amine oxidase, amino acid oxidase and cholesterol oxidase.

In the methods of the present invention, a temperature in the range of about 5 to about 120° C., preferably in the range of about 5 to about 80° C., and more preferably in the range of about 15 to about 70° C., and a pH in the range of about 2.5 to about 12, preferably between about 4 and about 10, more preferably in the range of about 4.0 to about 7.0 or in the range of about 7.0 to about 10.0, can be used. Preferably, a temperature and pH near the temperature and pH optima of the enzyme, respectively, are used.

The dyeing system used in the methods of the present invention may further comprise a mono- or divalent ion which includes, but is not limited to, sodium, potassium, calcium and magnesium ions (0–3 M, preferably 25 mM–1 M), a polymer which includes, but is not limited to, polyvinylpyrrolidone, polyvinylalcohol, polyaspartate, polyvinylamide, polyethylene oxide (0–50 g/l, preferably 1–500 mg/l) and a surfactant (10 mg–5 g/l).

Examples of such surfactants are anionic surfactants such as carboxylates, for example, a metal carboxylate of a long chain fatty acid; N-acylsarcosinates; mono or diesters of phosphoric acid with fatty alcohol ethoxylates or salts of such esters; fatty alcohol sulphates such as sodium dodecyl sulphate, sodium octadecyl sulphate or sodium cetyl sulphate; ethoxylated fatty alcohol sulphates; ethoxylated alkylphenol sulphates; lignin sulphonates; petroleum sulphonates; alkyl aryl sulphonates such as alkyl-benzene sulphonates or lower alkylnaphthalene sulphonates, e.g., butyl-naphthalene sulphonate; salts or sulphonated naphthalene-formaldehyde condensates; salts of sulphonated phenol-formaldehyde condensates; or more complex sulphonates such as amide sulphonates, e.g., the sulphonated condensation product of oleic acid and N-methyl taurine or the dialkyl sulphosuccinates, e.g., the sodium sulphonate or dioctyl succinate. Further examples of such surfactants are non-ionic surfactants such as condensation products of fatty acid esters, fatty alcohols, fatty acid amides or fatty-alkyl- or alkenyl-substituted phenols with ethylene oxide, block copolymers of ethylene oxide and propylene oxide, acetylenic glycols such as 2,4,7,9-tetraethyl-5-decyn-4,7-diol, or ethoxylated acetylenic glycols. Further examples of such surfactants are cationic surfactants such as aliphatic mono-, di-, or polyamines such as acetates, naphthenates or oleates; oxygen-containing amines such as an amine oxide of polyoxyethylene alkylamine; amide-linked amines prepared by the condensation of a carboxylic acid with a di- or polyamine; or quaternary ammonium salts.

In a preferred embodiment, the material is first soaked in an aqueous solution which comprises the one or more mono-, di- or polycyclic aromatic or heteroaromatic compounds; and then the soaked material is treated with the enzyme.

In another preferred embodiment, the dyeing system further comprises an agent which enhances the activity of the enzyme exhibiting peroxidase activity or the enzyme exhibiting oxidase activity. Enhancing agents are well known in the art. For example, the organic chemical compounds disclosed in WO 95/01426 are known to enhance the activity of a laccase. Furthermore, the chemical compounds disclosed in WO 94/12619 and WO 94/12621 are known to enhance the activity of a peroxidase.

The invention is further illustrated by the following non-limiting examples.

EXAMPLES

Example 1

Determination of Laccase Activity

Laccase activity was determined from the oxidation of syringaldazin under aerobic conditions. The violet color produced was measured by spectrophotometry at 530 nm. The analytical conditions were 19 $\mu$M syringaldazin, 23.2 mM acetate buffer, pH 5.5, 30° C., and 1 minute reaction time. One laccase unit (LACU) is the amount of laccase that catalyzes the conversion of 1 $\mu$mole syringaldazin per minute at these conditions.

Determination of Peroxidase Activity

One peroxidase unit (POXU) is the amount of enzyme that catalyzes the conversion of 1 $\mu$mol hydrogen peroxide per minute at the following analytical conditions: 0.88 mM hydrogenperoxide, 1.67 mM 2,2'-azinobis(3-ethylbenzothiazoline-6-sulfonate), 0.1 M phosphate buffer (containing Triton X405 (1.5 g/1000 ml)), pH 7.0, incubated at 30° C., photometrically followed at 418 nm (extinction coefficient of ABTS is set to 3.6 l/mmol*mm)).

Dyeing of Fabrics

Five mg of a first compound (p-phenylenediamine ("A"), p-tolulenediamine ("B"), or o-aminophenol ("C")) and 5 mg of a second compound (m-phenylenediamine ("D"), $\alpha$-naphthol ("E"), or 4-chlororesorcinol ("F")) (or 10 mg of the first compound in experiments without the second compound) were dissolved in 10 ml of 0.1 M $K_2HPO_4$, pH 7.0, buffer. A Polyporus pinsitus laccase ("PpL") with an activity of 71.7 LACU/ml (deposited with the Centraal Bureau voor Schimmelcultures and given accession number CBS 678.70) or a *Myceliophthora thermophila* laccase ("MtL") with an activity of 690 LACU/ml (deposited with the Centraal Bureau voor Schimmelcultures and given accession number CBS 117.65)) was diluted in the same buffer to an activity of 10 LACU/ml.

Multifiber swatches Style 10A (4×10 cm) obtained from Test Fabrics Inc. (Middlesex, N.J.) were rolled up and placed in a test tube. The swatches contained strips of different fibers made of cotton, diacetate, polyacrylic, polyamide and polyester. 4.5 ml of the precursor/coupler solution and 1 ml of the laccase solution were added to the test tubes. The test tubes were closed, mixed and mounted in a test tube shaker and incubated for 60 minutes in a dark cabinet. After incubation the swatches were rinsed in running hot tap water for about 30 seconds.

The results of the experiment are provided in the following tables:

TABLE 1

| FABRIC | A alone | A + D | A + E | A + F |
|---|---|---|---|---|
| diacetate | strong yellow/orange | blue | strong red purple | strong orange |
| cotton | gray blue | gray | gray | gray |
| polyester | gray | gray | gray | gray |
| polyacrylic | gray | gray | gray | gray |
| polyamide | gray | blue | strong purple | gray blue |

TABLE 2

| FABRIC | B alone | B + D | B + E | B + F |
|---|---|---|---|---|
| diacetate | strong red/orange | strong blue | strong purple | strong yellow/orange |
| cotton | gray red | gray blue | gray | gray |
| polyester | gray/orange | gray | gray | gray |
| polyacrylic | gray/orange | gray | gray | gray |
| polyamide | orange/red | blue | strong purple | gray yellow |

TABLE 3

| FABRIC | C alone | C + D | C + E | C + F |
|---|---|---|---|---|
| diacetate | strong yellow | strong yellow | strong orange | strong yellow/orange |
| cotton | light yellow | light yellow | light yellow | gray/yellow |
| polyester | light gray | light gray | gray | gray |
| polyacrylic | light gray | light gray | gray | gray |
| polyamide | strong orange/red | strong orange/red | strong orange | strong orange/red |

The results demonstrate that diacetate and polyamide are dyed intense shades, whereas polyacrylic, polyester and cotton are dyed light shades in the presence of precursor and *Polyporus pinsitus* laccase. Similar results are obtained with the *Myceliophthora thermophila* laccase.

Example 2

Various materials were dyed in an Atlas Launder-O-Meter ("LOM") at 30° C. for 1 hour at a pH in the range of 4–10. The materials dyed (all obtained from Test Fabrics Inc.) were Diacetate (Style 122, 5 cm×5 cm), Nylon 6 (Style 322, 5 cm×5 cm), Nylon 6.6 (Style 361, 5 cm×5 cm), Triacetate (Style 116, 5 cm×5 cm), Cotton (Style 400, 5 cm×5 cm), and Mercerized Cotton (Style 400M, 5 cm×5 cm).

A 0.1 M Britten-Robinson buffer solution was prepared at the appropriate pH by mixing solution A (0.1 M $H_3PO_4$, 0.1 M $CH_3COOH$, 0.1 M $H_3BO_3$) and B (0.5 M NaOH). In order to produce buffer solutions at pH's 4, 5, 6, 7, 8, 9 and 10, 806 ml, 742 ml, 706 ml, 656 ml, 624 ml, 596 ml and 562 ml of solution A, respectively, were diluted to one liter with solution B.

To 75 ml of each buffer solution was added 0.5 mg/ml of a compound selected from p-phenylenediamine, o-aminophenol and m-phenylenediamine. The pH was checked and adjusted if necessary. The 75 ml buffer/compound solutions were combined to form 150 ml of each buffer/compound combination solution which was added to a LOM beaker.

Swatches of the materials were then soaked in each buffer/compound combination solution. A volume corresponding to the volume of a laccase to be added was then withdrawn. A *Myceliophthora thermophila* laccase ("MtL") with an activity of 690 LACU/ml was diluted in the buffer solution to an activity of 300 LACU/ml. 2 LACU/ml was added for each pH, except pH 7.0. At pH 7.0, 0, 1, 2, 4 LACU/ml was added for the dosing profile. The LOM beakers were then mounted on the LOM. After 1 hour at 42 RPM and 30° C., the LOM was stopped. The liquid was poured off and the swatches were rinsed in the beaker in running deionized water for about 15 minutes. The swatches were dried and the CIELAB values measured using a ColorEye 7000 instrument. The CIELAB results are given in Tables 4–7.

TABLE 4

Dyeing with precursors p-phenylenediamine and m-phenylenediamine (pH-profile, 2 LACU/ml)

| | | pH 4 | pH 5 | pH 6 | pH 7 | pH 8 | pH 9 | pH 10 |
|---|---|---|---|---|---|---|---|---|
| Cotton | L* | 31.35 | 23.99 | 27.99 | 34.02 | 64.16 | 74.9 | 42.45 |
| | a* | 10.96 | 5.95 | 6.89 | 6.14 | 2.01 | 1.27 | 4.7 |
| | b* | 4.95 | 7.53 | 7.01 | 1.44 | −8.62 | −6 | −5.65 |
| Mercerized Cotton | L* | 29.02 | 29.11 | 28.1 | 35.15 | 64.63 | 71.1 | 44.21 |
| | a* | 13.41 | 12.88 | 6.64 | 5.97 | 1.55 | 0.9 | 3.96 |
| | b* | 8.03 | 7.56 | 7.24 | 0.55 | −7.03 | −6.84 | −3.11 |
| Diacetate | L* | 39.45 | 32.05 | 28.24 | 25.5 | 31.02 | 45.58 | 22.96 |
| | a* | 2.52 | 2.36 | 2.52 | 3.38 | 5.27 | 4.45 | 4.06 |
| | b* | −3.07 | −3.82 | −7.91 | −11.1 | −14.43 | −6.53 | −10.58 |
| Nylon 6 | L* | 55.93 | 48.58 | 45.77 | 36.2 | 35.7 | 42.49 | 32.29 |
| | a* | 2.94 | 2.3 | −0.71 | −1.55 | 1.7 | 0.47 | 1.15 |
| | b* | 0.31 | 1.8 | −5.06 | −18.65 | −28.18 | −28.81 | −25.11 |
| Nylon 6.6 | L* | 47.11 | 39.61 | 35.12 | 27.92 | 32.79 | 39.75 | 26.46 |
| | a* | 3.11 | 2.65 | 0.32 | −0.58 | 1.82 | 0.59 | 1.3 |
| | b* | 0.89 | 2.36 | −3.73 | −15.04 | −26.17 | −25.78 | −21.27 |
| Triacetate | L* | 64.17 | 53.17 | 52.87 | 53.91 | 67.24 | 72.57 | 59.08 |
| | a* | 4.4 | 5.55 | 5.26 | 4.84 | 3.25 | 2.48 | 3.95 |
| | b* | 0.73 | 2.9 | 2.5 | −0.7 | −6.55 | −2.25 | −6.68 |

TABLE 5

Dyeing with precursors p-phenylenediamine and m-phenylenediamine (Dosing profile - pH 7)

| | | 0 LACU | 1 LACU | 4 LACU |
|---|---|---|---|---|
| Cotton | L* | 78.65 | 36.72 | 32.73 |
| | a* | 1.45 | 6.24 | 6.38 |
| | b* | 1.49 | 0.48 | 2.24 |
| Mercerized Cotton | L* | 77.74 | 37.34 | 34.15 |
| | a* | 1.36 | 5.89 | 6.58 |
| | b* | 1.79 | −0.65 | 1.6 |

TABLE 5-continued

Dyeing with precursors p-phenylenediamine and m-phenylenediamine (Dosing profile - pH 7)

| | | 0 LACU | 1 LACU | 4 LACU |
|---|---|---|---|---|
| Diacetate | L* | 57.32 | 26.21 | 24.78 |
| | a* | 2.07 | 3.62 | 3.24 |
| | b* | −1.85 | −12.44 | −10.1 |
| Nylon 6 | L* | 66.27 | 36.55 | 35.59 |
| | a* | 0.92 | −1.18 | −1.66 |
| | b* | −4.69 | −20.74 | −16.68 |
| Nylon 6.6 | L* | 61.37 | 28.93 | 27.02 |
| | a* | 1.4 | −0.52 | −0.63 |
| | b* | −4.07 | −16.68 | −13.26 |
| Triacetate | L* | 75.68 | 56.01 | 51.16 |
| | a* | 1.87 | 4.65 | 4.85 |
| | b* | 3 | −2.54 | −1.49 |

TABLE 6

Dyeing with precursors o-aminophenol and m-phenylenediamine (pH-profile, 2 LACU/ml)

| | | pH 4 | pH 5 | pH 6 | pH 7 | pH 8 | pH 9 | pH 10 |
|---|---|---|---|---|---|---|---|---|
| Cotton | L* | 21.6 | 26.83 | 36.75 | 44.64 | 49.53 | 79.1 | 74.84 |
| | a* | 2.56 | 2.85 | 3.85 | 4.22 | 3.76 | 4.08 | 7.45 |
| | b* | 5.33 | 6.89 | 11.37 | 13.34 | 8.74 | 19.56 | 25.31 |
| Mercerized Cotton | L* | 27.89 | 27.22 | 44.1 | 45.18 | 53.4 | 79.4 | 75.27 |
| | a* | 2.17 | 2.69 | 2.1 | 4.02 | 4.77 | 3.69 | 7.56 |
| | b* | 4.79 | 6.92 | 8.64 | 13.38 | 1.97 | 19.22 | 25.27 |
| Diacetate | L* | 35.6 | 33.59 | 36.47 | 37.78 | 45.78 | 62.9 | 57.42 |
| | a* | 3.6 | 4.12 | 8.47 | 10.47 | 10.11 | 6.59 | 7.06 |
| | b* | 10.36 | 13.65 | 22.21 | 27.16 | 32.99 | 37.21 | 37.8 |
| Nylon 6 | L* | 43.42 | 44.93 | 47.57 | 47.52 | 52.25 | 64.09 | 60.9 |
| | a* | 2.84 | 3.68 | 8.01 | 9.8 | 8.4 | 10.09 | 9.29 |
| | b* | 8.51 | 12.32 | 22.52 | 25.94 | 27.31 | 34.18 | 32.24 |
| Nylon 6.6 | L* | 36.77 | 34.57 | 36.26 | 37 | 43.69 | 55.9 | 52.68 |
| | a* | 3.08 | 3.71 | 7.63 | 11.22 | 12.38 | 16.31 | 17.05 |
| | b* | 9.43 | 11.35 | 19.14 | 23.86 | 29.68 | 37.83 | 37.52 |
| Triacetate | L* | 39.02 | 40.38 | 48.7 | 51.8 | 59.23 | 68.95 | 69.74 |
| | a* | 3.1 | 3.56 | 4.8 | 5 | 3.96 | 7.15 | 5.73 |
| | b* | 7.92 | 9.83 | 18.94 | 24.89 | 27.7 | 40.73 | 37.62 |

TABLE 7

Dyeing with precursors o-aminophenol and m-phenylenediamine (Dosing profile - pH 7)

| | | 0 LACU | 1 LACU | 4 LACU |
|---|---|---|---|---|
| Cotton | L* | 86.79 | 46.58 | 44.66 |
| | a* | 0.08 | 3.91 | 4.12 |
| | b* | 10.05 | 13.12 | 12.31 |
| Mercerized Cotton | L* | 86.25 | 49.91 | 49.32 |
| | a* | 0.16 | 2.86 | 3.08 |
| | b* | 8.22 | 10.94 | 7.18 |
| Diacetate | L* | 76.33 | 40.46 | 37.43 |
| | a* | 1.76 | 9.8 | 11.78 |
| | b* | 21.99 | 28.08 | 27.66 |
| Nylon 6 | L* | 82.6 | 49.91 | 46.77 |
| | a* | 0.31 | 10.07 | 9.56 |
| | b* | 14.72 | 27.48 | 25.13 |
| Nylon 6.6 | L* | 77.4 | 38.87 | 37.5 |
| | a* | 2.42 | 11.83 | 12.44 |
| | b* | 18.4 | 25.88 | 24.88 |
| Triacetate | L* | 77.02 | 54.5 | 49.23 |
| | a* | 3.54 | 5.35 | 5.19 |
| | b* | 19.62 | 28.23 | 23.54 |

The parameters "L*", "a*" and "b*" used in the tables are used to quantify color and are well known to persons of ordinary skill in the art of color science. See for example, Billmeyer & Saltzman, *Principles of Color Technology,* Second Edition, John Wiley & Sons, New York, 1981, p. 59.

The results show that cotton and mercerized cotton were dyed with both compound combinations at low pH with intense colors observed at a pH below 6. Diacetate was dyed at all pHs, with the combination of p-phenylenediamine and m-phenylenediamine yielding colors ranging from gray at low pH to marine blue at high pH and the combination of o-aminophenol and m-phenylenediamine giving colors ranging from umber to orange/yellow. Nylon 6 was dyed at all pH's, with strong blue shades at pH's greater than 6 and gray shades at lower pH's with the combination of p-phenylenediamine and m-phenylenediamine. The combination of o-aminophenol and m-phenylenediamine gave beige at pH's greater than 6 and gray shades at lower pH's. Nylon 6.6 was dyed in much the same way as Nylon 6, however, stronger shades are developed at all pH's. Triacetate was not significantly dyed by the combination of p-phenylenediamine and m-phenylenediamine, but some brown to beige color development was formed at the lower pH's with the combination of o-aminophenol and m-phenylenediamine.

In all dosing experiments, no notable difference was seen from dosing 1, 2 or 4 LACU/ml. The control experiment with 0 LACU/ml clearly demonstrates that dyeing is catalyzed by the laccase.

Example 3

The time profile for dyeing was determined using the procedure described in Example 2 except the experiments were conducted only at pH 5.0 and 8.0 over time intervals of 0, 5, 15, 35 and 55 minutes. In each experiment, 2 LACU/ml of the *Myceliophthora thermophila* laccase was added. The results are shown in Tables 8–11.

TABLE 8

Dyeing with precursors p-phenylenediamine and m-phenylenediamine Time profile, 2 LACU/ml, pH 5

| | | 0 min | 5 min | 15 min | 35 min | 55 min |
|---|---|---|---|---|---|---|
| Cotton | L* | 54.68 | 32.54 | 36.94 | 27.88 | 28.91 |
| | a* | 2.16 | 2.79 | 2.84 | 2.75 | 2.69 |
| | b* | 8.26 | 7.93 | 8.67 | 7.06 | 7.23 |
| Mercerized Cotton | L* | 79.56 | 56.58 | 41.97 | 29.12 | 27.36 |
| | a* | 1.97 | 7.72 | 12.06 | 12.77 | 11.15 |
| | b* | 0.62 | 10.2 | 11.02 | 10.65 | 9.4 |
| Diacetate | L* | 78.96 | 50.08 | 38.79 | 30.89 | 30.77 |
| | a* | 0.1 | 1.06 | 1.62 | 1.87 | 1.96 |
| | b* | 1.69 | −6.35 | −5.22 | −3.71 | −3.81 |
| Nylon 6 | L* | 86.15 | 73.4 | 59.07 | 48.45 | 47.61 |
| | a* | −0.54 | −0.07 | 0.79 | 2.96 | 3.04 |
| | b* | 1.96 | 0.5 | 1.98 | 4.32 | 3.89 |
| Nylon 6.6 | L* | 84.26 | 67.05 | 52.34 | 41.07 | 39.38 |
| | a* | −1.12 | 0.19 | 1.23 | 3.16 | 3.21 |
| | b* | 0.54 | 0.49 | 3.51 | 4.96 | 4.14 |
| Triacetate | L* | 86.27 | 80.68 | 69.35 | 54.88 | 52.79 |
| | a* | 0.99 | 1.83 | 3.28 | 5.61 | 5.49 |
| | b* | 3.46 | 4.99 | 2.05 | 4.8 | 5.07 |

TABLE 9

Dyeing with precursors p-phenylenediamine and m-phenylenediamine Time profile, 2 LACU/m/, pH 8

| | | 0 min | 5 min | 15 min | 35 min | 55 min |
|---|---|---|---|---|---|---|
| Cotton | L* | 79.54 | 57.37 | 48 | 46.03 | 44.07 |
| | a* | 0.39 | 2.57 | 3.53 | 4.18 | 4.57 |
| | b* | −3.66 | −6.57 | −6.25 | −3.98 | −3.18 |
| Mercerized | L* | 77.4 | 62.14 | 52.8 | 49.77 | 48.64 |

TABLE 9-continued

Dyeing with precursors p-phenylenediamine and m-phenylenediamine Time profile, 2 LACU/m/, pH 8

| | | 0 min | 5 min | 15 min | 35 min | 55 min |
|---|---|---|---|---|---|---|
| Cotton | a* | 0.43 | 2.85 | 3.68 | 4.68 | 4.79 |
| | b* | −0.96 | −4.16 | −4.04 | −2.29 | 0.01 |
| Diacetate | L* | 72.72 | 31.72 | 24.53 | 22.6 | 22.91 |
| | a* | −0.24 | 4.65 | 4.71 | 4.29 | 3.6 |
| | b* | −8.41 | −19.15 | −14.73 | −11.97 | −12.11 |
| Nylon 6 | L* | 64.65 | 53.49 | 39.32 | 37.64 | 33.14 |
| | a* | −3.28 | −2.23 | −0.58 | −0.35 | 0.06 |
| | b* | −16.61 | −20.1 | −23.66 | −23.99 | −23.75 |
| Nylon 6.6 | L* | 61.83 | 43.78 | 33.61 | 29.96 | 27.21 |
| | a* | −2.03 | −0.89 | 0.05 | 0.25 | 0.35 |
| | b* | −17.12 | −21.06 | −21.5 | −20.87 | −20.5 |
| Triacetate | L* | 83.59 | 70.82 | 66.6 | 66.43 | 65.41 |
| | a* | 0.93 | 1.58 | 1.6 | 1.99 | 2.88 |
| | b* | 3.54 | −1.66 | −0.64 | −1.17 | −0.01 |

TABLE 10

Dyeing with precursors o-aminophenol and m-phenylenediamine Time profile, 2 LACU/ml, pH 5

| | | 0 min | 5 min | 15 min | 35 min | 55 min |
|---|---|---|---|---|---|---|
| Cotton | L* | 74.17 | 55.46 | 38.63 | 25.68 | 23.63 |
| | a* | 2.1 | 7.02 | 14.76 | 6.58 | 5.39 |
| | b* | 0.3 | 7.23 | 11.76 | 8.67 | 7.71 |
| Mercerized Cotton | L* | 86.46 | 60.02 | 40.5 | 34.54 | 34.19 |
| | a* | 0.91 | 0.89 | 1.43 | 1.19 | 1.56 |
| | b* | 6.9 | 6.56 | 6.5 | 4.46 | 5.15 |
| Diacetate | L* | 80.72 | 51.54 | 36.25 | 33.63 | 34.33 |
| | a* | 1.21 | 6.27 | 6.56 | 5.76 | 4.83 |
| | b* | 12.63 | 21.98 | 18.26 | 16.13 | 14.76 |
| Nylon 6 | L* | 85.97 | 61.61 | 47.63 | 44.22 | 46.02 |
| | a* | 0.13 | 5.08 | 5.61 | 4.71 | 4.52 |
| | b* | 8.21 | 15.36 | 13.92 | 13.06 | 13.89 |
| Nylon 6.6 | L* | 82.27 | 55.28 | 39.06 | 35.9 | 36.73 |
| | a* | 1.34 | 5.72 | 5.97 | 4.91 | 4.29 |
| | b* | 11.84 | 17.23 | 14.3 | 13.13 | 12.9 |
| Triacetate | L* | 89.33 | 69.67 | 50.12 | 42.38 | 42.98 |
| | a* | 0.35 | 2.18 | 5.O5 | 4.26 | 3.8 |
| | b* | 6.37 | 13.43 | 12.88 | 11.24 | 10.17 |

TABLE 11

Dyeing with precursors o-aminophenol and m-phenylenediamine Time profile, 2 LACU/ml, pH 8

| | | 0 min | 5 min | 15 min | 35 min | 55 min |
|---|---|---|---|---|---|---|
| Cotton | L* | 87.77 | 75.41 | 61.59 | 49.57 | 48.57 |
| | a* | −0.44 | 6.2 | 5.51 | 4.26 | 4.08 |
| | b* | 13.54 | 26.92 | 15.47 | 9.83 | 8.31 |
| Mercerized Cotton | L* | 88 | 78.8 | 61.48 | 50.78 | 50.5 |
| | a* | −0.4 | 4.09 | 6.72 | 5.07 | 4.95 |
| | b* | 11.59 | 22.84 | 15.18 | 5.37 | 2.55 |
| Diacetate | L* | 84.64 | 69.78 | 51.84 | 46.03 | 42.15 |
| | a* | 0.24 | 4.78 | 11.54 | 11.14 | 11.87 |
| | b* | 14.06 | 38.86 | 39.15 | 34.67 | 32.58 |
| Nylon 6 | L* | 82.81 | 69.06 | 56.09 | 50.38 | 50.5 |
| | a* | 0.08 | 6.61 | 10.18 | 7.06 | 7.72 |
| | b* | 16.44 | 29.39 | 27.89 | 23.35 | 26.07 |
| Nylon 6.6 | L* | 81.49 | 61.73 | 49.21 | 42.34 | 41.72 |
| | a* | 1.22 | 11.92 | 14.82 | 11.75 | 11.52 |
| | b* | 16.5 | 33.84 | 31.26 | 26.59 | 27.05 |
| Triacetate | L* | 84.73 | 79.49 | 68.57 | 60.03 | 60.89 |
| | a* | 1.88 | 2.45 | 4.87 | 3.98 | 4.12 |
| | b* | 13.78 | 21.92 | 26.33 | 23.41 | 24.59 |

The results show that most of the color forms within the first 15 minutes. Cotton and mercerized cotton were dyed with both compound combinations at pH 5, with intense colors after 35 minutes. Diacetate was dyed at both pH's, with most color forming after 15 minutes. Nylon 6 and Nylon 6.6 were dyed at both pH's, with most color forming after 15 min. Nylon 6.6, however, developed stronger shades. Triacetate was not dyed at either pH by the combination of p-phenylenediamine and m-phenylenediamine, but some color formed with the combination of o-aminophenol and m-phenylenediamine.

Example 4

The materials dyed (all obtained from Test Fabrics, Inc.) were cotton (style 400, 8 cm×8 cm), Diacetate (style 122, 5 cm×6 cm), Nylon 6.6 (style 361, 6 cm×6 cm), and Nylon 6 (style 322, 6 cm×6 cm) in an Atlas Launder-O-Meter ("LOM") at 30° C. for one hour at pH 5.5.

A 0.5 mg/ml solution of a first compound (p-phenylenediamine, "A") and a 0.5 mg/ml solution of a second compound (1-naphthol, "B") was prepared by dissolving the compound(s) in the appropriate amount of 0.1 M $CH_3COONa$, pH 5.5, buffer. A total volume of 100 ml was used in each LOM beaker. 100 ml "A" was added to one beaker and 50 ml "A" and 50 ml "B" were combined to form 100 ml in a second beaker. Swatches of the materials listed above were wetted in DI water and soaked in the precursor solutions. A *Myceliophthora thermophila* laccase ("MtL") with an activity of 690 LACU/ml (80 LACU/mg) was added to each beaker at a concentration of 12.5 mg/l. The LOM beakers were sealed and mounted in the LOM. After 1 hour at 42 RPM and 30° C., the LOM was stopped. The spent liquor was poured off and the swatches were rinsed in cold tap water for about 15 minutes. The swatches were dried at room temperature and CIELAB values were measured for all of the swatches using the Macbeth ColorEye 7000. The results are given in Tables 12 and 13.

TABLE 12

Dyeing with precursor p-phenylenediamine

| | L* | a* | b* |
|---|---|---|---|
| Cotton | 27.10 | 76.39 | 11.20 |
| Nylon 6.6 | 42.38 | 53.76 | 26.07 |
| Nylon 6 | 55.72 | 68.58 | 26.37 |
| Diacetate | 33.38 | 65.07 | 19.01 |

TABLE 13

Dyeing with precursors p-phenylnediamine and 1-naphthol

| | L* | a* | b* |
|---|---|---|---|
| Cotton | 39.73 | 70.79 | 3.34 |
| Nylon 6.6 | 30.96 | 48.94 | −6.96 |
| Nylon 6 | 39.93 | 65.81 | −7.08 |
| Diacetate | 21.06 | 66.60 | −7.87 |

The results show that different types of fiber can be dyed using precursor and *Myceliophthora thermophila* laccase (brown shades with A, and purple shades with A/B).

Example 5

The materials dyed (all obtained from Test Fabrics, Inc.) were cotton (style 400, 8 cm×8 cm), Diacetate (style 122, 5 cm×6 cm), Nylon 6.6 (style 361, 6 cm×6 cm), and Nylon 6 (style 322, 6 cm×6 cm) in an Atlas Launder-O-Meter ("LOM") at 30° C. for one hour at pH 5.5.

A 0.5 mg/ml solution of a first compound (p-phenylenediamine, "A") and a 0.5 mg/ml solution of a second compound (1-naphthol, "B") was prepared by dissolving the compound in the appropriate amount of 0.1 M $CH_3COONa$, pH 5.5, buffer. A total volume of 100 ml was used in each LOM beaker. 100 ml "A" was added to one beaker and 50 ml "A" and 50 ml "B" were combined to form 100 ml in a second beaker. Swatches of the materials listed above were wetted in DI water and soaked in the precursor solutions. A *Polyporus pinsitus* laccase ("PpL") with an activity of 70 LACU/ml (100 LACU/mg) was added to each beaker at a concentration of 12.5 mg/l. The LOM beakers were sealed and mounted in the LOM. After 1 hour at 42 RPM and 30° C., the LOM was stopped. The spent liquor was poured off and the swatches were rinsed in cold tap water for about 15 minutes. The swatches were dried at room temperature and CIELAB values were measured for all of the swatches using the Macbeth ColorEye 7000. The results are given in Tables 14 and 15.

TABLE 14

Dyeing with precursor p-phenylenediamine

| | L* | a* | b* |
|---|---|---|---|
| Cotton | 35.03 | 86.23 | 9.45 |
| Nylon 6.6 | 42.27 | 59.54 | 27.72 |
| Nylon 6 | 58.08 | 70.91 | 25.75 |
| Diacetate | 37.60 | 70.48 | 22.80 |

TABLE 15

Dyeing with precursors p-phenylnediamine and 1-naphthol

| | L* | a* | b* |
|---|---|---|---|
| Cotton | 46.48 | 74.06 | 2.93 |
| Nylon 6.6 | 38.12 | 54.12 | −1.68 |
| Nylon 6 | 49.36 | 65.94 | −4.56 |
| Diacetate | 29.66 | 68.56 | −5.46 |

The results show that different fiber types can be dyed (brown shades with A, and purple shades with A/B) using precursor and *Polyporous pinsitus* (PpL) laccase.

Example 6

The materials dyed (all obtained from Test Fabrics, Inc.) were cotton (style 400, 8 cm×8 cm), Diacetate (style 122, 5 cm×6 cm), Nylon 6.6 (style 361, 6 cm×6 cm), and Nylon 6 (style 322, 6 cm×6 cm) in an Atlas Launder-O-Meter ("LOM") at 30° C. for one hour at pH 5.5.

A 0.5 mg/ml solution of a first compound (p-phenylenediamine, "A") and a 0.5 mg/ml solution of a second compound (1-naphthol, "B") was prepared by dissolving the compound in the appropriate amount of 0.1 M $CH_3COONa$, pH 5.5, buffer. A total volume of 100 ml was used in each LOM beaker. 100 ml "A" was added to one beaker and 50 ml "A" and 50 ml "B" were combined to form 100 ml in a second beaker. Swatches of the materials listed above were wetted in DI water and soaked in the precursor solutions. A *Myrothecium verrucaria* bilirubin oxidase ("BiO") with an activity of 0.04 LACU/mg (1 mg/ml) was added to each beaker at a concentration of 12.5 mg/l. The LOM beakers were sealed and mounted in the LOM. After 1 hour at 42 RPM and 30° C., the LOM was stopped. The spent liquor was poured off and the swatches were rinsed in cold tap water for about 15 minutes. The swatches were dried at room temperature and CIELAB values were measured for all of the swatches using the Macbeth ColorEye 7000. The results are given in Tables 16 and 17.

TABLE 16

Dyeing with precursor p-phenylenediamine

| | L* | a* | b* |
|---|---|---|---|
| Cotton | 47.48 | 94.37 | 9.55 |
| Nylon 6.6 | 46.26 | 79.82 | 5.70 |
| Nylon 6 | 53.70 | 82.65 | 1.72 |
| Diacetate | 32.39 | 85.54 | 8.94 |

TABLE 17

Dyeing with precursors p-phenylnediamine and 1-naphthol

| | L* | a* | b* |
|---|---|---|---|
| Cotton | 67.47 | 95.17 | −4.24 |
| Nylon 6.6 | 42.88 | 91.04 | −25.78 |
| Nylon 6 | 49.28 | 91.17 | −25.97 |
| Diacetate | 25.22 | 103.98 | −23.95 |

The results show that various materials can be dyed (brown shades with A, and purple shades with A/B) using precursor and bilirubin oxidase.

Example 7

The materials dyed (all obtained from Test Fabrics, Inc.) were cotton (style 400, 8 cm×8 cm), Diacetate (style 122, 5 cm×6 cm), Nylon 6.6 (style 361, 6 cm×6 cm), and Nylon 6 (style 322, 6 cm×6 cm) in an Atlas Launder-O-Meter ("LOM") at 30° C. for one hour at pH 5.5.

A 0.5 mg/ml solution of a first compound (p-phenylenediamine, "A") and a 0.5 mg/ml solution of a second compound (1-naphthol, "B") was prepared by dissolving the compound in the appropriate amount of 0.1 M $CH_3COONa$, pH 5.5, buffer. A total volume of 100 ml was used in each LOM beaker. 100 ml "A" was added to one beaker and 50 ml "A" and 50 ml "B" were combined to form 100 ml in a second beaker. Swatches of the materials listed above were wetted in DI water and soaked in the precursor solutions. A *Rhizoctonia solani* laccase ("RsL") with an activity of 5.2 LACU/mg (2 mg/ml) was added to each beaker at a concentration of 12.5 mg/l. The LOM beakers were sealed and mounted in the LOM. After 1 hour at 42 RPM and 30° C., the LOM was stopped. The spent liquor was poured off and the swatches were rinsed in cold tap water for about 15 minutes. The swatches were dried at room temperature and CIELAB values were measured for all of the swatches using the Macbeth ColorEye 7000. The results are given in Tables 18 and 19.

TABLE 18

Dyeing with precursor p-phenylenediamine

| | L* | a* | b* |
|---|---|---|---|
| Cotton | 50.41 | 58.97 | 1.59 |
| Nylon 6.6 | 47.73 | 54.3 | 12.93 |
| Nylon 6 | 53.94 | 66.74 | 9.49 |
| Diacetate | 33.38 | 71.45 | 10.27 |

TABLE 19

Dyeing with precursors p-phenylnediamine and 1-naphthol

| | L* | a* | b* |
|---|---|---|---|
| Cotton | 29.03 | 63.94 | −3.65 |
| Nylon 6.6 | 31.91 | 63.98 | −8.10 |
| Nylon 6 | 39.41 | 68.87 | −13.38 |
| Diacetate | 17.78 | 75.03 | −8.45 |

The results show that different fiber types can be dyed (brown shades with A, and purple shades with A/B) using precursor and *Rhizoctonia solani* laccase.

Example 8

The material dyed (obtained from Test Fabrics Inc.) was Cotton (Style 400, 8 cm×8 cm) in an Atlas Launder-O-Meter ("LOM") at 60° C. and pH 5.5.

A 0.25 mg/ml solution of a first compound (p-phenylenediamine, "A") and a 0.25 mg/ml solution of a second compound (2-aminophenol, "B") were prepared by dissolving the compound in the appropriate amount of a 2 g/L $CH_3COONa$, pH 5.5, buffer. A total volume of 100 ml was used in each LOM beaker. 50 ml "A" and 50 ml "B" were combined to form 100 ml in an LOM beaker. Swatches of the material listed above were then wetted in DI water and soaked in the precursor solutions. The LOM beaker was sealed and mounted in the LOM. After a 10 minute incubation time in the LOM (42 RPM), the LOM was stopped and a *Myceliophthora thermophila* laccase ("MtL") with an activity of 690 LACU/ml (80 LACU/mg) was added to the beaker at a concentration of 1 LACU/ml. After 20 minutes at 42 RPM and 60° C., the LOM was stopped and the sample was removed. Two controls without preincubation were made by adding the precursor solution, swatches, and enzyme to LOM beakers. The beakers were mounted in the LOM. After 15 minutes at 42 RPM and 60° C., one beaker was removed. The other control was run for a total of 30 minutes at 42 RPM and 60° C. and then removed. The spent liquor was poured off the samples and the swatches were rinsed in cold tap water for about 15 minutes. The swatches were dried at room temperature and CIELAB values were measured for all of the swatches using the Macbeth ColorEye 7000. The results are given in Tables 20–22.

TABLE 20

Control Dyeing with precursors A and B, 0 min./15 min.

| | L* | a* | b* |
|---|---|---|---|
| Cotton | 51.92 | 6.35 | 10.83 |

TABLE 21

Control Dyeing with precursors A and B, 0 min./30 min.

| | L* | a* | b* |
|---|---|---|---|
| Cotton | 51.05 | 6.17 | 11.13 |

TABLE 22

| Dyeing with precursors A and B, 10 min./20 min. | | | |
|---|---|---|---|
| | L* | a* | b* |
| Cotton | 49.97 | 5.81 | 11.76 |

The colorfastness to laundering (washfastness) for these swatches was evaluated using the American Association of Textile Chemist and Colorist (AATCC) Test Method 61-1989, 2A. The Launder-O-Meter was preheated to 49° C. and 200 ml 0.2% AATCC Standard Reference Detergent WOB (without optical brightener) and 50 steel balls were placed in each LOM beaker. The beakers were sealed and mounted in the LOM and run at 42 RPM for 2 minutes to preheat the beakers to the test temperature. The rotor was stopped and the beakers were unclamped. The swatches were added to the beakers and the LOM was run for 45 minutes. The beakers were removed and the swatches rinsed in hot tap water for 5 minutes, with occasional squeezing. The swatches were then dried at room temperature and evaluated by the Macbeth ColorEye 7000. A gray scale rating (1–5) was assigned to each swatch using the AATCC Evaluation Procedure 1, Gray Scale for Color Change. The results are given in Tables 23–25.

TABLE 23

| Washfastness Results for A and B, 0 min./15 min. | | | | |
|---|---|---|---|---|
| | L* | a* | b* | Gray Scale Rating |
| Cotton | 53.63 | 6.15 | 10.86 | 4–5 |

TABLE 24

| Washfastness Results for A and B, 0 min./30 min. | | | | |
|---|---|---|---|---|
| | L* | a* | b* | Gray Scale Rating |
| Cotton | 52.95 | 6.04 | 10.23 | 4–5 |

TABLE 25

| Washfastness Results for A and B, 10 min./20 min. | | | | |
|---|---|---|---|---|
| | L* | a* | b* | Gray Scale Rating |
| Cotton | 50.40 | 5.71 | 9.97 | 5 |

The results show that cotton can be dyed using precursor and *Myceliophthora thermophila* (MtL) laccase. Both from the L* and gray scale rating, it is evident that color intensity and washfastness are improved by incubating the swatches in the precursor solution before adding the enzyme.

Example 9

Cotton was dyed in an Atlas Launder-O-Meter ("LOM") at 40° C. for one hour at a pH 5.5. The material dyed (obtained from Test Fabrics Inc.) was Cotton (Style 400, 8 cm×8 cm)

Two mediators were evaluated in this experiment and each was dissolved in a buffer solution. Three buffer solutions were made: a 2 g/L $CH_3COONa$, pH 5.5, buffer ("1"), a 2 g/L $CH_3COONa$, pH 5.5, buffer containing 100 $\mu$M 10-propionic acid-phenothiazine (PPT) ("2"), and a 2 g/L $CH_3COONa$, pH 5.5, buffer containing 100 $\mu$M methyl syringate ("3").

Three 0.25 mg/ml solutions of a compound (p-phenylenediamine, "A") were prepared by dissolving the compound in the appropriate amount of buffer (1, 2 or 3). A total volume of 120 ml was used in each LOM beaker. Swatches of the material listed above were wetted in DI water and soaked in the precursor solutions. The LOM beakers were sealed and mounted in the LOM. After 10 minutes at 42 RPM and 40° C., the LOM was stopped. A *Myceliophthora thermophila* laccase ("MtL") with an activity of 690 LACU/ml (80 LACU/mg) was added to each beaker at an activity of 0.174 LACU/ml. The beakers were once again sealed and mounted in LOM and run (42 RPM) for 50 minutes at 40° C. The beakers were removed and the spent liquor was poured off and the swatches were rinsed in cold tap water for about 15 minutes. The swatches were dried at room temperature and CIELAB values were measured for all of the swatches using the Macbeth ColorEye 7000. The results are given in Tables 26, 27 and 28.

TABLE 26

| Dyeing with precursor A (2 g/L $CH_3COONa$, pH 5.5, MtL) | | | |
|---|---|---|---|
| | L* | a* | b* |
| Cotton | 47.57 | 7.39 | 4.04 |

TABLE 27

| Dyeing with precursor A (2 g/L $CH_3COONa$, pH 5.5, 100 $\mu$M PPT, MtL) | | | |
|---|---|---|---|
| | L* | a* | b* |
| Cotton | 53.16 | 6.84 | 4.01 |

TABLE 28

| Dyeing with precursor A (2 g/L $CH_3COONa$, pH 5.5, 100 $\mu$M methyl syringate, MtL) | | | |
|---|---|---|---|
| | L* | a* | b* |
| Cotton | 54.34 | 8.19 | 8.68 |

The colorfastness to laundering (washfastness) for these swatches was evaluated using the American Association of Textile Chemist and Colorist (AATCC) Test Method 61-1989, 2A. The Launder-O-Meter was preheated to 49° C. and 200 ml 0.2% AATCC Standard Reference Detergent WOB (without optical brightener) and 50 steel balls were placed in each LOM beaker. The beakers were sealed and mounted in the LOM and run at 42 RPM for 2 minutes to preheat the beakers to the test temperature. The rotor was stopped and the beakers were unclamped. The swatches were added to the beakers and the LOM was run for 45 minutes. The beakers were removed and the swatches rinsed in hot tap water for 5 minutes, with occasional squeezing. The swatches were then dried at room temperature and evaluated by the Macbeth ColorEye 7000. A gray scale rating (1–5) was assigned to each swatch using the AATCC Evaluation Procedure 1, Gray Scale for Color Change. The results are in Tables 29–31.

TABLE 29

| Washfastness Results for precursor A (2 g/L $CH_3COONa$, pH 5.5, MtL) | | | | |
|---|---|---|---|---|
| | L* | a* | b* | Gray Scale Rating |
| Cotton | 53.08 | 8.22 | 5.82 | 2–3 |

TABLE 30

| Washfastness results for precursor A (2 g/L $CH_3COONa$, pH 5.5, 100 μM PPT, MtL) | | | | |
|---|---|---|---|---|
| | L* | a* | b* | Gray Scale Rating |
| Cotton | 55.64 | 7.52 | 5.58 | 4 |

TABLE 31

| Washfastness Results for precursor A (2 g/L $CH_3COONa$, pH 5.5, 100 μM methyl syringate, MtL) | | | | |
|---|---|---|---|---|
| | L* | a* | b* | Gray Scale Rating |
| Cotton | 57.83 | 8.47 | 9.13 | 3 |

The same experiment was repeated, except that a second compound (2-aminophenol, "B") and a third compound (m-phenylenediamine, "C") were used. The temperature used was 70° C. The results are given in Tables 32–37.

TABLE 32

| Dyeing with precursors B and C (2 g/L $CH_3COONa$, pH 5.5, MtL) | | | |
|---|---|---|---|
| | L* | a* | b* |
| Cotton | 56.32 | 0.36 | −3.80 |

TABLE 33

| Dyeing with precursors B and C (2 g/L $CH_3COONa$, pH 5.5, 100 μM PPT, MtL) | | | |
|---|---|---|---|
| | L* | a* | b* |
| Cotton | 56.04 | 1.01 | −1.34 |

TABLE 34

| Dyeing with precursors B and C (2 g/L $CH_3COONa$, pH 5.5, 100 μM methyl syringate, MtL) | | | |
|---|---|---|---|
| | L* | a* | b* |
| Cotton | 54.09 | 2.44 | 4.82 |

TABLE 35

| Washfastness Results for precursors B and C (2 g/L $CH_3COONa$, pH 5.5, MtL) | | | | |
|---|---|---|---|---|
| | L* | a* | b* | Gray Scale Rating |
| Cotton | 58.20 | 0.75 | −1.69 | 4–5 |

TABLE 36

| Washfastness results for precursors B and C (2 g/L $CH_3COONa$, pH 5.5, 100 μM PPT, MtL) | | | | |
|---|---|---|---|---|
| | L* | a* | b* | Gray Scale Rating |
| Cotton | 58.94 | 2.38 | 1.97 | 3–4 |

TABLE 37

| Washfastness Results for precursors B and C (2 g/L $CH_3COONa$, pH 5.5, 100 μM methyl syringate, MtL) | | | | |
|---|---|---|---|---|
| | L* | a* | b* | Gray Scale Rating |
| Cotton | 59.91 | 3.09 | 5.13 | 2–3 |

The results from these two sets of experiments show that a mediator may be used for dyeing and for obtaining improved washfastness. In both experiments, cotton was dyed at pH 5.5 in a $CH_3COONa$ buffer, in a $CH_3COONa$ buffer containing PPT, and in a $CH_3COONa$ buffer containing methyl syringate. However, a mediator resulted in improved washfastness only in the first experiment.

Example 10

The materials dyed (all obtained from Test Fabrics, Inc.) were cotton (style 400, 6 cm×6 cm), Diacetate (style 122, 5 cm×6 cm), Nylon 6.6 (style 361, 6 cm×6 cm), and Nylon 6 (style 322, 6 cm×6 cm) in an Atlas Launder-O-Meter ("LOM") at 30° C. for one hour at pH 5.5.

A 0.5 mg/ml solution of a first compound (p-phenylenediamine, "A") and a 0.5 mg/ml solution of a second compound (1-naphthol, "B") was prepared by dissolving the compound in the appropriate amount of 0.1 M $CH_3COONa$, pH 5.5, buffer. A total volume of 100 ml was used in each LOM beaker. 100 ml "A" was added to one beaker and 50 ml "A" and 50 ml "B" were combined to form 100 ml in a second beaker. Swatches of the materials listed above were wetted in DI water and soaked in the precursor solutions. A *Coprinus cinereus* peroxidase ("CiP") with an activity of 180,000 POXU/ml was added to each beaker at a concentration of 0.05 POXU/ml. Either 200 or 500 μM hydrogen peroxide was added to each LOM beaker. The LOM beakers were sealed and mounted in the LOM. After 1 hour at 42 RPM and 30° C., the LOM was stopped. The spent liquor was poured off and the swatches were rinsed in cold tap water for about 15 minutes. The swatches were dried at room temperature and CIELAB values were measured for all of the swatches using the Macbeth ColorEye 7000. The results are given in Tables 38–41.

TABLE 38

| Dyeing with precursor A, 200 μM $H_2O_2$ | | | |
|---|---|---|---|
| | L* | a* | b* |
| Cotton | 74.57 | 2.17 | −1.83 |
| Nylon 6.6 | 68.75 | 3.19 | 0.99 |
| Nylon 6 | 74.73 | 2.37 | 1.86 |
| Diacetate | 54.49 | 6.34 | 2.10 |

TABLE 39

| Dyeing with precursor A,500 μM $H_2O_2$ | | | |
|---|---|---|---|
| | L* | a* | b* |
| Cotton | 65.49 | 3.18 | −1.94 |
| Nylon 6.6 | 64.11 | 3.76 | −0.30 |
| Nylon 6 | 56.71 | 5.81 | 1.48 |
| Diacetate | 58.64 | 3.95 | 2.49 |

TABLE 40

| Dyeing with precursors A and B, 200 μM $H_2O_2$ | | | |
|---|---|---|---|
| | L* | a* | b* |
| Cotton | 76.58 | 4.86 | −1.45 |
| Nylon 6.6 | 59.16 | 6.29 | −20.92 |
| Nylon 6 | 65.33 | 5.11 | −18.75 |
| Diacetate | 44.06 | 21.67 | −20.13 |

TABLE 41

| Dyeing with precursors A and B, 500 μM $H_2O_2$ | | | |
|---|---|---|---|
| | L* | a* | b* |
| Cotton | 75.02 | 4.99 | −2.11 |
| Nylon 6.6 | 52.69 | 7.88 | −23.32 |
| Nylon 6 | 58.72 | 6.61 | −21.75 |
| Diacetate | 35.16 | 23.70 | −22.26 |

The results show that different fiber types can be dyed (purple shades with A and A/B) using precursor, peroxide and *Coprinus cinereus* (CiP) peroxidase.

Example 11

A print paste is made by dissolving 5 mg/ml of paraphenylenediamine in 0.1 M sodium phosphate, pH 5.5 buffer and adding 2.5% gum arabic. The print paste is manually transferred to a nylon fabric using a printing screen and a scraper. The portions of the fabric which are not to be printed are covered by a mask.

The fabric is then steamed for 10 minutes in a steam chamber and allowed to dry.

Color is developed by dipping the fabric into a 2 LACU/ml laccase solution following by a one hour incubation.

Example 12

A mono-, di- or polycyclic aromatic or heteroaromatic compound may be applied to the material by padding. For example, 0.5 mg/ml of p-phenylenediamine is dissolved in 500 ml of 0.1 M $K_2PO_4$, pH 7, buffer. A laccase is diluted in the same buffer. The p-phenylenediamine solution is padded on the material using a standard laboratory pad at 60° C. The fabric is steamed for 10 minutes. The steamed material may then be padded a second time with the enzyme solution. The dye is allowed to develop by incubating the swatches at 40° C. After incubation, the swatches are rinsed in running hot tap water for about 30 seconds.

What is claimed is:

1. A method of dyeing a material comprising treating the material with a dyeing system which comprises (a) one or more mono-, di- or polycyclic aromatic or heteroaromatic compounds, wherein said hetero aromatic compounds do not include indoles, each of which is optionally substituted with one or more functional groups or substituents, wherein each functional group or substituent is selected from the group consisting of halogen; sulfo; sulfonato; sulfamino; sulfanyl; amino; amide; nitro; azo; imino; carboxy; cyano; formyl; hydroxy; halocarbonyl; carbamoyl; carbamidoyl; phosphonato; phosphonyl; $C_{1-18}$alkenyl; $C_{1-18}$alkyl; $C_{1-18}$alkynyl; $C_{1-18}$alkoxy; $C_{1-18}$oxycarbonyl; $C_{1-18}$oxyalkyl; $C_{1-18}$alkyl sulfanyl; $C_{1-18}$alkyl sulfonyl; $C_{1-18}$alkyl imino and amino which is substituted with one, two or three $C_{1-18}$alkyl groups; wherein each $C_{1-18}$alkyl; $C_{1-18}$alkenyl and $C_{1-18}$alkynyl group may be mono-, di or poly-substituted by any of the proceeding functional groups or substituents; and (b) (i) a hydrogen peroxide source and an enzyme exhibiting peroxidase activity or (ii) an enzyme exhibiting oxidase activity on the one or more aromatic or heteroaromatic compounds; wherein the material is fabric, yarn, fiber, garment or film made of cotton, diacetate, flax, linen, lyocel, polyacrylic, synthetic polyamide, polyester, ramie, rayon, tencel or triacetate.

2. The method according to claim 1, wherein the one or more mono-, di- or polycyclic aromatic or heteroaromatic compounds is a naphthol.

3. The method according to claim 1, wherein the one or more mono-, di- or polycyclic aromatic or heteroaromatic compounds is an aromatic diamine.

4. The method according to claim 1, wherein the one or more mono-, di- or polycyclic aromatic or heteroaromatic compounds is an aminophenol.

5. The method according to claim 1, wherein the one or more mono-, di- or polycyclic aromatic or heteroaromatic compounds is a phenol.

6. The method according to claim 1, wherein the material is made of cotton.

7. The method according to claim 1, wherein the material is made of diacetate.

8. The method according to claim 1, wherein the material is made of flax.

9. The method according to claim 1, wherein the material is made of linen.

10. The method according to claim 1, wherein the material is made of lyocel.

11. The method according to claim 1, wherein the material is made of polyacrylic.

12. The method according to claim 1, wherein the material is made of nylon.

13. The method according to claim 1, wherein the material is made of polyester.

14. The method according to claim 1, wherein the material is made of ramie.

15. The method according to claim 1, wherein the material is made of rayon.

16. The method according to claim 15, wherein the material is made of viscose.

17. The method according to claim 1, wherein the material is made of tencel.

18. The method according to claim 1, wherein the material is made of triacetate.

19. The method according to claim 1, wherein the dyeing system comprises an enzyme exhibiting peroxidase activity on the one or more mono-, di- or polycyclic aromatic or heteroaromatic compounds and a hydrogen peroxide source.

20. The method according to claim 19, wherein the enzyme is a peroxidase or haloperoxidase.

21. The method according to claim 1, wherein the dyeing system comprises an enzyme exhibiting oxidase activity on the one or more mono-, di- or polycyclic aromatic or heteroaromatic compounds.

22. The method according to claim 21, wherein the enzyme is selected from the group consisting of bilirubin oxidase, catechol oxidase, laccase, o-aminophenol oxidase, and polyphenol oxidase.

23. The method according to claim 1, wherein the material is treated with the dyeing system at a temperature in the range of about 5 to about 120° C.

24. The method according to claim 1, wherein the material is treated with the dyeing system at a pH in the range of about 4 to about 10.

25. The method according to claim 1, wherein the dyeing system further comprises a mono or divalent ion selected from the group consisting of sodium, potassium, calcium and magnesium ions.

26. The method according to claim 1, wherein the dyeing system further comprises a polymer selected from the group consisting of polyvinylpyrrolidone, polyvinylalcohol, polyaspartate, polyvinylamide, and polyethylene oxide.

27. The method according to claim 1, wherein the dyeing system further comprises an anionic, nonionic or cationic surfactant.

28. The method according to claim 1, wherein the dyeing system further comprises an agent which enhances the activity of the enzyme.

* * * * *

UNITED STATES PATENT AND TRADEMARK OFFICE
CERTIFICATE OF CORRECTION

| | | |
|---|---|---|
| PATENT NO. | : | 5,972,042 |
| DATED | : | October 26, 1999 |
| INVENTOR(S) | : | Martin Barfoed |

It is certified that error appears in the above-identified patent and that said Letters Patent is hereby corrected as shown below:

On the title page:

Item [73], line 2: delete "Germany" and insert --Denmark--

Col. 24, claim 1, line 4: delete "amide" and insert --amido--
Col. 24, claim 1, line 6: delete "$C_{1-18}$alkenyl; $C_{1-18}$alkyl" and insert --$C_{1-18}$alkyl; $C_{1-18}$alkenyl--
Col. 24, claim 1, line 7: delete "$C_{1-18}$oxyalkyl" and insert --$C_{1-18}$oxoalkyl--
Col. 24, claim 1, line10: delete "$C_{1-18}$alkyl;" and insert --$C_{1-18}$alkyl,--

Signed and Sealed this

Twenty-sixth Day of December, 2000

*Attest:*

Q. TODD DICKINSON

*Attesting Officer*

*Director of Patents and Trademarks*